US008919565B2

(12) United States Patent
Yamaguchi et al.

(10) Patent No.: US 8,919,565 B2
(45) Date of Patent: Dec. 30, 2014

(54) EJECTOR SYSTEM FOR COLOR SORTER

(75) Inventors: Haruyoshi Yamaguchi, Tokyo (JP); Naoto Takahashi, Tokyo (JP); Nobuyoshi Ikeda, Tokyo (JP)

(73) Assignee: Satake Corporation (JP)

( * ) Notice: Subject to any disclaimer, the term of this patent is extended or adjusted under 35 U.S.C. 154(b) by 52 days.

(21) Appl. No.: 13/811,865

(22) PCT Filed: Jul. 22, 2011

(86) PCT No.: PCT/JP2011/004134
§ 371 (c)(1),
(2), (4) Date: Jan. 23, 2013

(87) PCT Pub. No.: WO2012/017611
PCT Pub. Date: Feb. 9, 2012

(65) Prior Publication Data

US 2013/0118959 A1 May 16, 2013

(30) Foreign Application Priority Data

Aug. 5, 2010 (JP) ..... 2010-176736

(51) Int. Cl.

| | |
|---|---|
| ***B07C 5/00*** | (2006.01) |
| ***B07B 4/02*** | (2006.01) |
| ***B07C 5/342*** | (2006.01) |
| ***B07C 5/36*** | (2006.01) |

(52) U.S. Cl.
CPC ..... *B07B 4/02* (2013.01); *B07C 5/3427* (2013.01); *B07C 5/368* (2013.01); *B07C 5/3425* (2013.01); *Y10S 209/932* (2013.01)
USPC ..... 209/44.2; 209/644; 209/932

(58) Field of Classification Search
USPC ..... 209/44.2, 576, 639, 644, 932
See application file for complete search history.

(56) References Cited

U.S. PATENT DOCUMENTS 3,216,567 A * 11/1965 Kelly et al. ..... 209/571
3,472,375 A * 10/1969 Mathews ..... 209/576

(Continued)

FOREIGN PATENT DOCUMENTS

JP 5169037 7/1993 ..... B07C 5/342
JP 8252535 10/1996 ..... B07B 13/00

(Continued)

OTHER PUBLICATIONS

International Search Report issued for corresponding application No. PCT/JP2011/004134, dated Nov. 15, 2011 (2 pgs).

(Continued)

*Primary Examiner* — Joseph C Rodriguez
(74) *Attorney, Agent, or Firm* — Hayes Soloway P.C.

(57) ABSTRACT

An ejector system for a color sorter, eliminates particulate matter by air by detection of the particulate matter falling from an end of a transfer device at a predetermined position, and has a nozzle part in which a plurality of air flow paths that communicate with a plurality of nozzle holes are formed. A manifold part is provided with a plurality of electromagnetic valves that communicate with an air space communicating with a compressed air source and in which a plurality of air flow paths for supplying compressed air to the corresponding air flow paths in the nozzle part by the operation of the respective electromagnetic valves are formed. The nozzle part and the manifold part are separably integrated while open surfaces of the air flow paths in the nozzle part and open surfaces of the air flow paths in the manifold part are brought into contact with each other.

11 Claims, 14 Drawing Sheets

(56) References Cited

U.S. PATENT DOCUMENTS

| | | | | | |
|---|---|---|---|---|---|
| 4,099,620 | A | * | 7/1978 | Kendall et al. | 209/587 |
| 4,909,930 | A | * | 3/1990 | Cole | 209/564 |
| 5,273,166 | A | * | 12/1993 | Sawamura | 209/587 |
| 5,339,965 | A | * | 8/1994 | Klukis et al. | 209/639 |
| 5,350,118 | A | * | 9/1994 | Mitchell et al. | 239/551 |
| 5,555,984 | A | * | 9/1996 | Sommer et al. | 209/580 |
| 5,819,373 | A | * | 10/1998 | Schlichter et al. | 19/205 |
| 6,260,712 | B1 | * | 7/2001 | Flottmann et al. | 209/639 |
| 7,014,126 | B2 | * | 3/2006 | Boertje et al. | 239/266 |
| 2014/0014746 | A1 | * | 1/2014 | Watanabe | 239/584 |

FOREIGN PATENT DOCUMENTS

| | | | |
|---|---|---|---|
| JP | 11267596 | 10/1999 | B02B 7/00 |
| JP | 2004160400 | 6/2004 | B07C 5/342 |
| KR | 10 0925209 | 10/2009 | B07C 5/342 |

OTHER PUBLICATIONS

Chinese Office Action issued in Chinese Appln. No. 201180033085.8 on Aug. 26, 2013, with English translation, 7 pgs.

* cited by examiner

EJECTOR SYSTEM FOR COLOR SORTER

TECHNICAL FIELD

The present invention relates to an ejector system employed in a color sorter for sorting acceptable items and unacceptable items from among rice, wheat, or other grains; resin pellets; coffee beans; or other such particulate matter; or for eliminating foreign matter admixed into particulate matter.

BACKGROUND ART

Color sorters that sort acceptable items and unacceptable items in particulate matter, or that eliminate foreign matter admixed into particulate matter, are widely known in the prior art.

In a color sorter, particulate matter that is launched into the air, for example, from the edge of a chute or belt, is irradiated with light, whereupon the reflected light or transmitted light from the particulate matter is detected by sensors. The detection signal is compared with a reference value to identify unacceptable items or foreign matter, whereupon the unacceptable items or foreign matter are eliminated by being carried away with jets of air from ejector nozzles or the like, thereby sorting the particulate matter (see Patent Documents 1 and 2, for example).

FIG. 13 shows the ejector nozzle of the sorter disclosed in Patent Document 1. The ejector nozzle 101 has a plurality of slit-like air jet holes 102 and a plurality of holes 103 communicating with the air jet holes 102, with hoses 104 that connect to a jet air supply, not shown, fitted into each of the plurality of holes 103 to jet air from the air jet holes 102.

However, a problem with the ejector nozzle 101 in question is that difficulties arise when the hoses 104 dislodge from the holes 103. Moreover, dust and dirt tends to collect in the ejector nozzle 101, including the hoses 104, making frequent cleaning and maintenance necessary.

FIG. 14 shows an air jetting device of the sorter disclosed in Patent Document 2. In the air jetting device 111 in question, a plurality of nozzle blocks 112, a plurality of electromagnetic valves 113 connected in duct-wise fashion to the plurality of nozzle blocks 112, and a single receiver tank 114 connected in duct-wise fashion plurality of electromagnetic valves 113 are arranged on a base 115. In the air jetting device 111 in question, compressed air held in the receiver tank 114 is supplied through ducts to the electromagnetic valves 113, and when a specific electromagnetic valve 113 is opened, air is supplied through a duct to the corresponding nozzle block 112, whereupon air is jetted from a nozzle 116 formed at the tip of the nozzle block 112.

In the air jetting device 111, the nozzle blocks 112 and the electromagnetic valves 113 are respectively connected by ducts, so there is no problem of difficulties arising when the hoses 104 dislodge from the holes 103, as in the aforedescribed ejector nozzle 101.

However, in the air jetting device 111, the plurality of nozzle blocks 112, the plurality of electromagnetic valves 113, and the receiver tank 114 are respectively connected by ducts and arranged on the base 115, making cleaning and maintenance elaborate.

CITATION LIST

Patent Literature

Patent Document 1: Japanese Laid-Open Patent Application 8-252535

Patent Document 2: Japanese Laid-Open Patent Application 5-169037

SUMMARY OF INVENTION

Technical Problem

An object of the present invention is to offer an ejector system for a color sorter, having excellent cleaning and maintenance performance.

Solution to Problem

In order to attain the aforedescribed object, the present invention is an ejector system for a color sorter in which particulate matter falling from the end of a transfer means is detected at a predetermined position, and based on the result of the detection, the particulate matter is eliminated by air, characterized by being constituted from: a nozzle part in which a plurality of nozzle holes open at the front end, and in which are formed a plurality of air flow paths that communicate with the nozzle holes; and a manifold part in which is formed an air space communicating with a compressed air source, the manifold part being provided with a plurality of electromagnetic valves communicating with the air space, and in which are formed a plurality of air flow paths for supplying compressed air to corresponding air flow paths of the nozzle part by operation of the electromagnetic valves, the nozzle part and the manifold part being separably integrated in a state in which the open surfaces of the air flow paths in the nozzle part and the open surfaces of the air flow paths in the manifold part are brought in contact with each other.

In the present invention, in preferred practice, the open surfaces of the air flow paths in the nozzle part and the open surfaces of the air flow paths in the manifold part are fitted together as projections and recesses, and the nozzle part and the manifold part are separably integrated by a pair of rods extending from the manifold part being inserted into a pair of through-holes formed in the nozzle part.

In the present invention, in preferred practice, the nozzle part is constituted by screwing together a nozzle upper member and a nozzle lower member, the manifold part is constituted by screwing together a manifold upper member and a manifold lower member, and the air flow paths are formed on opposed surfaces of the respective upper and lower members.

In the present invention, in preferred practice, the arrangement with respect to the color sorter is such that the nozzle part is positioned on the flow path of the particulate matter, and the manifold part is positioned in the interior of the sorter body.

In the present invention, in preferred practice, at one side end of the upper surface of the nozzle part, there is arranged an air sweeper provided with nozzles opening towards the other side end of the upper surface of the nozzle part; in the nozzle part, there are formed air flow paths that communicate with the nozzles of the air sweeper; and in the manifold part, there are arranged electromagnetic valves that communicate with the air space, and there are formed air flow paths that, by operation of the electromagnetic valves, supply compressed air to air flow paths communicating with the nozzles of the air sweeper formed in the nozzle part.

In the present invention, in preferred practice, the plurality of electromagnetic valves are arranged in a plurality of rows, in a phase-shifted state with respect to the manifold part.

Advantageous Effects of Invention

According to the ejector system for a color sorter in the present invention, the nozzle part and the manifold part are separably integrated in a state in which the open surfaces of the air flow paths in the nozzle part and the open surfaces of the air flow paths in the manifold part are brought in contact with each other, whereby the difficulties with hose dislodgment encountered in the prior art do not arise, and cleaning and maintenance performance are excellent.

In the ejector system of the present invention, when the open surfaces of the air flow paths in the nozzle part and the open surfaces of the air flow paths in the manifold part are fitted together as projections and recesses, and a pair of rods extending from the manifold part are inserted into a pair of through-holes formed in the nozzle part, the nozzle part and the manifold part can be separated easily, improving the cleaning and maintenance performance.

In the ejector system of the present invention, when the nozzle part is constituted by screwing together a nozzle upper member and a nozzle lower member, the manifold part is constituted by screwing together a manifold upper member and a manifold lower member, and the air flow paths are formed on opposed surfaces of the respective upper and lower members, the upper and lower members of the nozzle part and of the manifold part can be separated easily, and the air flow paths can be cleaned easily.

When the ejector system of the present invention is arranged with respect to the color sorter such that the manifold part is positioned in the interior of the sorter body, the electromagnetic valves do not become soiled by dust and the like stirred up within the flow path in association with falling of the particulate matter, and the burden of cleaning and maintenance is reduced.

In the ejector system of the present invention, when one side end of the upper surface of the nozzle part has arranged thereon an air sweeper provided with nozzles opening towards the other side end of the upper surface of the nozzle part, starting material or dust and the like accumulating on the upper surface of the nozzle part can be automatically cleaned away, reducing the burden of cleaning and maintenance by workers.

In the ejector system of the present invention, when the plurality of electromagnetic valves are arranged in a plurality of rows in a phase-shifted state with respect to the manifold part, the number of nozzle holes can be increased, as compared to a case in which the electromagnetic valves are arranged in a single row.

DESCRIPTION OF EMBODIMENTS

The following description of the embodiments of the present invention makes reference to the drawings.

<Overview of Color Sorter>

An overview of the color sorter is now described.

Figure 1:
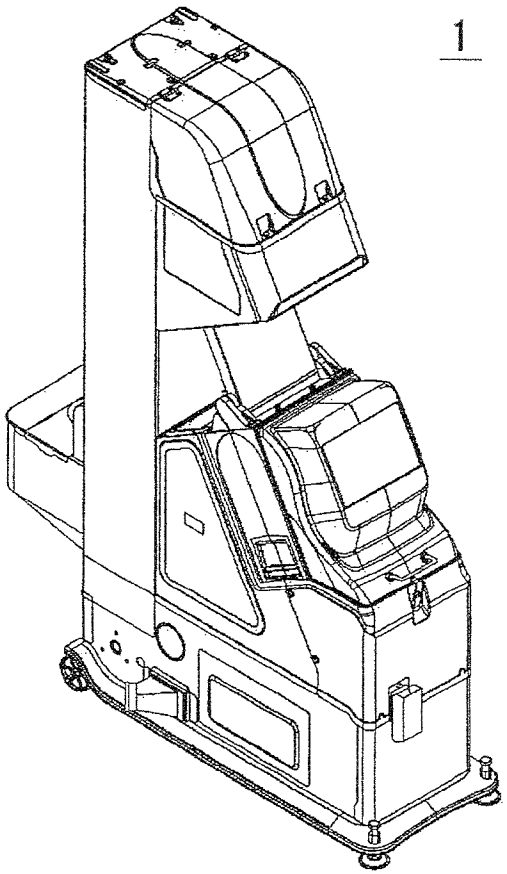
FIG. 1 is an exterior perspective view of a color sorter.
Figure 2:
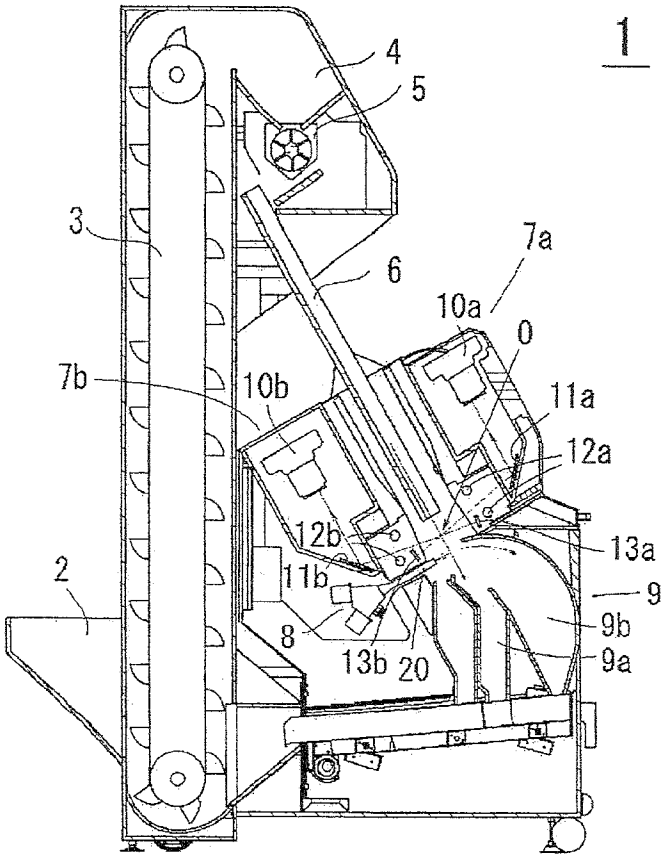
FIG. 2 is a simplified side sectional view of the color sorter.

FIG. 1 is an example of a color sorter, showing an exterior perspective view thereof. FIG. 2 shows a simplified side sectional view of the color sorter shown in FIG. 1.

The color sorter 1 in question is provided with a loading hopper 2 for loading particulate matter; a bucket conveyor 3 for lifting the particulate matter up into the top part of the sorter 1; a storage tank 4 for storing the lifted particulate matter; a rotary valve 5 arranged in the outlet of the storage tank 4; a sloping chute 6 having predetermined width, arranged below the rotary valve 5; a pair of optical detection devices 7*a*, 7*b* arranged to the front and back with the sloping chute 6 therebetween; an ejector system 8 arranged below the optical detection devices 7*a*, 7*b*; and a particulate matter discharge trough 9 arranged below the ejector system 8.

The optical detection devices 7*a*, 7*b* are provided with sensors 10*a*, 10*b*, mirrors 11*a*, 11*b*, illumination means 12*a*, 12*b*, and background means 13*a*, 13*b*.

As the sensors 10*a*, 10*b*, there are employed CCD line sensors or the like, constituted by a plurality of photodetector elements concatenated in a line pattern and assigned to a position in the width direction of the sloping chute 6, for example.

The background means 13*a*, 13*b* are arranged to the back of a particulate matter detection position O on the optical axes of the sensors 10*a*, 10*b*.

The optical detection devices 7*a*, 7*b* are adapted to detect particulate matter falling from the bottom edge of the sloping chute 6, at positions in the width direction of the falling trajectory thereof.

The ejector system 8 is also provided with a nozzle part 20 having a plurality of nozzle holes assigned to positions in the width direction of the sloping chute 6. Based on the results detected by the optical detection devices 7*a*, 7*b*, particulate matter falling from the bottom edge of the sloping chute 6 is carried away by jets of air from nozzle holes at corresponding positions in the width direction of the falling trajectory thereof.

The particulate matter discharge trough 9 is provided with a satisfactory item discharge trough 9*a* arranged along the falling trajectory of the particulate matter from the bottom edge of the sloping chute 6, and with an unsatisfactory item discharge trough 9*b* arranged at a position allowing the falling trajectory of the particulate matter to be modified by a jet of air from a nozzle hole of the nozzle part 20 constituting the ejector system 8.

In the color sorter 1, particulate matter loaded into the loading hopper 2 is lifted by the bucket conveyor 3 and stored in the storage tank 4. The particulate matter, which is supplied from the storage tank 4 at a constant flow rate via the rotary valve 5, spreads out across the width direction of the sloping chute 6, and flows down naturally in a continuous manner. Falling particulate matter having been launched into the air from the bottom edge of the sloping chute 6 is illuminated by the illumination means 12*a*, 12*b* of the pair of optical detection devices 7*a*, 7*b*, and with the background means 13*a*, 13*b* as the background, is imaged by the sensors 10*a*, 10*b* at a particulate matter detection position O extending linearly in the width direction of the sloping chute 6, whereby unsatisfactory items or foreign matter are identified by comparing the voltage value of the image signal to a reference threshold value, or the like. Particulate matter identified as being satisfactory items then falls into the satisfactory item trough 9*a* arranged along a predetermined falling trajectory. Particulate matter identified as being unsatisfactory items or foreign matter is carried away by air jetted at predetermined timing from a nozzle hole that opens onto a predetermined position of the nozzle part 20 constituting the ejector system 8, and falls into the unsatisfactory item trough 9*b*.

Alternatively, satisfactory items, instead of unsatisfactory items or foreign matter, may be the particulate matter that is carried away by air in this way.

<Ejector System>

The ejector system of the present invention is now described.

Figure 3:
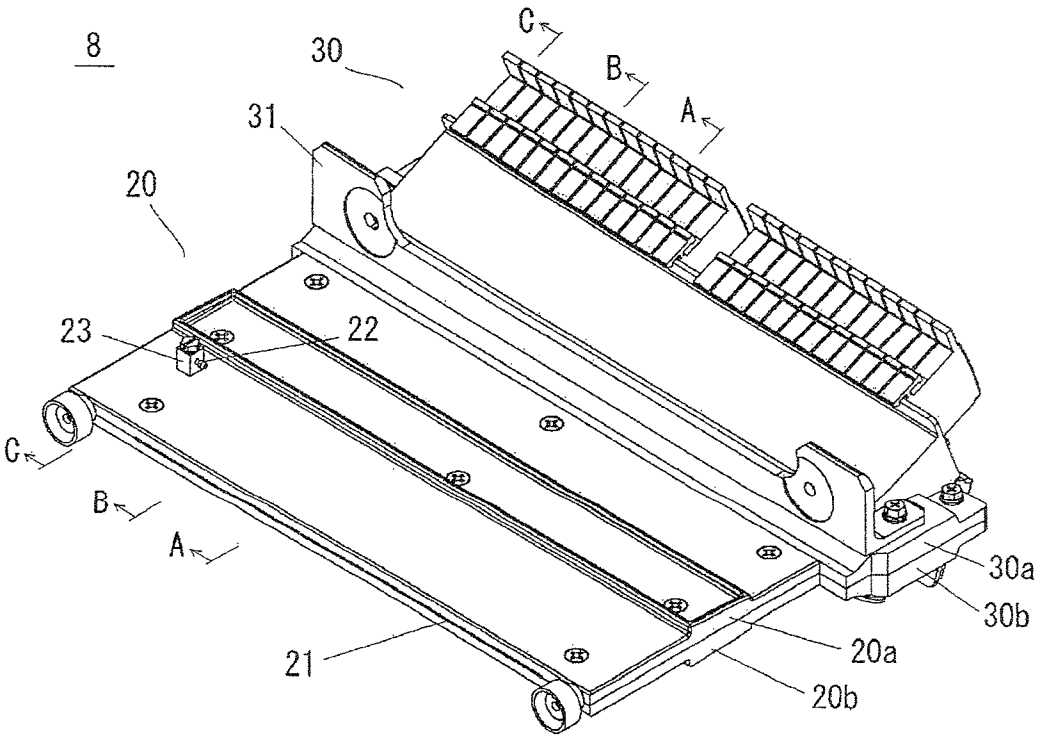
FIG. 3 is a perspective view of an ejector system.

FIG. 3 is a perspective view of an ejector system in an embodiment of the present invention.

Figure 4:
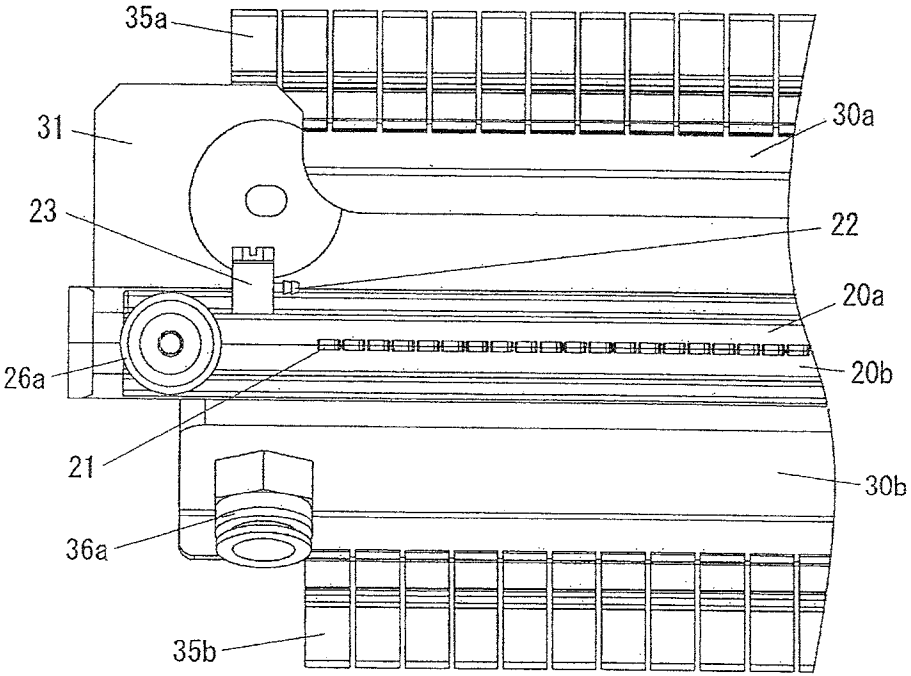
FIG. 4 is a fragmentary enlarged front view of the ejector system.

FIG. 4 is a fragmentary enlarged front view of the ejector system shown in FIG. 3.

As shown in FIG. 3, the ejector system 8 in the present embodiment is constituted by a nozzle part 20 and a manifold part 30.

The nozzle part 20 is constituted by screwing together a nozzle upper member 20*a* and a nozzle lower member 20*b*. The manifold part 30 is constituted by screwing together a manifold upper member 30*a* and a manifold lower member 30*b*.

Here, as will be clear from FIG. 4, a plurality of nozzle holes 21 open along the width direction at the front surface of the nozzle part 20. Moreover, as shown in FIGS. 3 and 4, at one side end of the upper surface of the nozzle part 20, there is arranged an air sweeper 23 provided with nozzles 22 that open towards the other side end of the upper surface thereof.

An attachment member 31 for attaching the ejector system 8 to the color sorter is screwed to the front of the upper face of the manifold upper member 30*a*.

Figure 5:
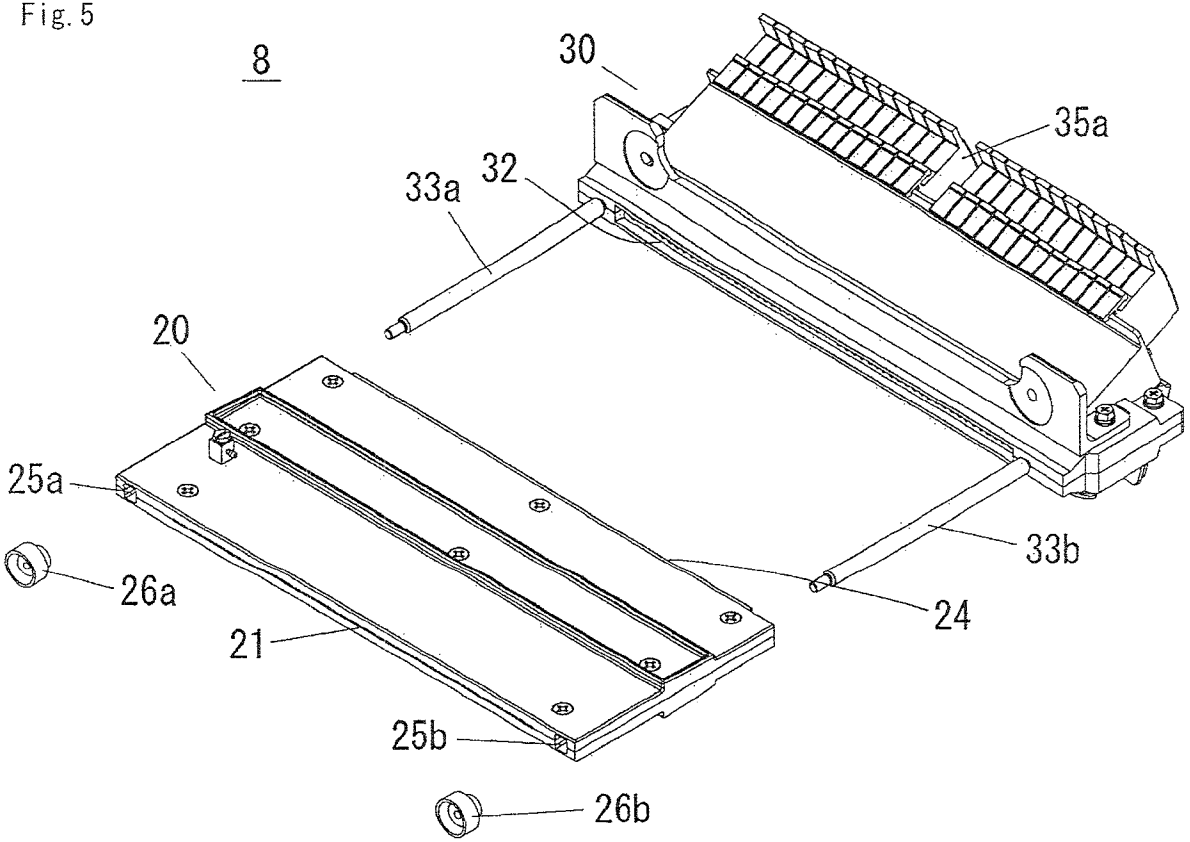
FIG. 5 is an exploded view of the ejector system.
Figure 6:
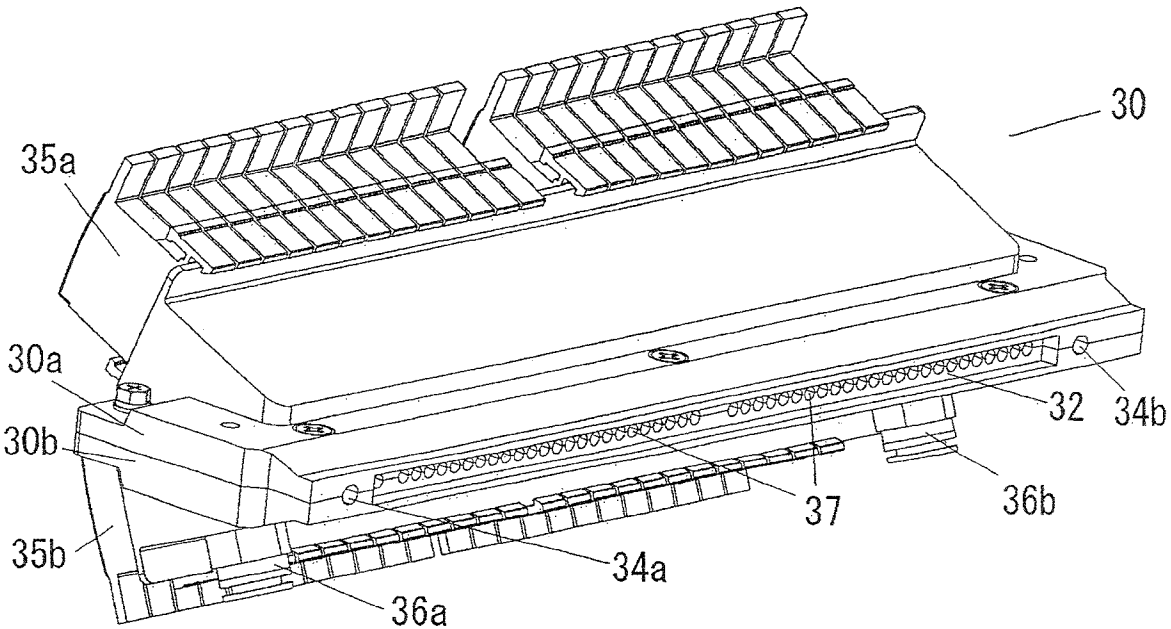
FIG. 6 is a perspective view of a manifold part.

FIG. 5 shows a view of the ejector system shown in FIG. 3, with the nozzle part and the manifold part exploded. FIG. 6 is a perspective view of the exploded manifold part.

As shown in FIG. 5, a laterally elongated recess part 32 is formed on the front surface of the manifold part 30, and a pair of rods 33*a*, 33*b* are formed at either side of the recess part 32.

Meanwhile, a laterally-elongated projection part 24 is formed on the back surface of the nozzle part 20, and a pair of through-holes 25*a*, 25*b* are formed at either side of the projection part 24.

Here, as will be clear from FIG. 6, a plurality of air flow paths 37 communicating with the nozzle holes 21 open along the width direction into the recess part 32 formed on the front surface of the manifold part 30. Attachment holes 34*a*, 34*b* for the pair of rods 33*a*, 33*b* are formed at either side of the recess part 32.

As shown in FIGS. 4 and 6, a plurality of electromagnetic valves 35*a*, 35*b* are arranged, in correspondence with the air flow paths 37 that open into the recess part 32, along the width direction on the back face of the manifold upper member 30*a* and of the manifold lower member 30*b*. A pair of air line connection parts 36*a*, 36*b* for connecting compressed air supply lines are arranged on the lower surface of the manifold lower member 30*b*.

Here, as will be clear from FIG. 4, the electromagnetic valves 35*a*, 35*b* are arranged in a phase-shifted state in the width direction, with respect to the manifold upper and lower members 30*a*, 30*b*.

As the electromagnetic valves 35*a*, 35*b* there may be employed any of the widely known types, and therefore a description is omitted here.

In the ejector system 8 of the present embodiment, the nozzle part 20 and the manifold part 30 are integrated by inserting the pair of rods 33*a*, 33*b* attached to the manifold part 30 into the pair of through-holes 25*a*, 25*b* formed in the nozzle part 20; and in a state in which the projection part 24 formed on the back surface of the nozzle part 20 has been mated into the recess part 32 formed on the front surface of the manifold part 30, female thread parts of fastening members 26*a*, 26*b* shown in FIG. 5 are threaded and tightened onto distal end male thread parts of the rods 33*a*, 33*b* that project out through the through-holes 25*a*, 25*b*.

In the ejector system of the present embodiment, because the nozzle part 20 and the manifold part 30 are integrated through tightening of the fastening members 26*a*, 26*b*, the nozzle part 20 and the manifold part 30 can be easily separated, for improved cleaning and maintenance performance.

Figure 7:
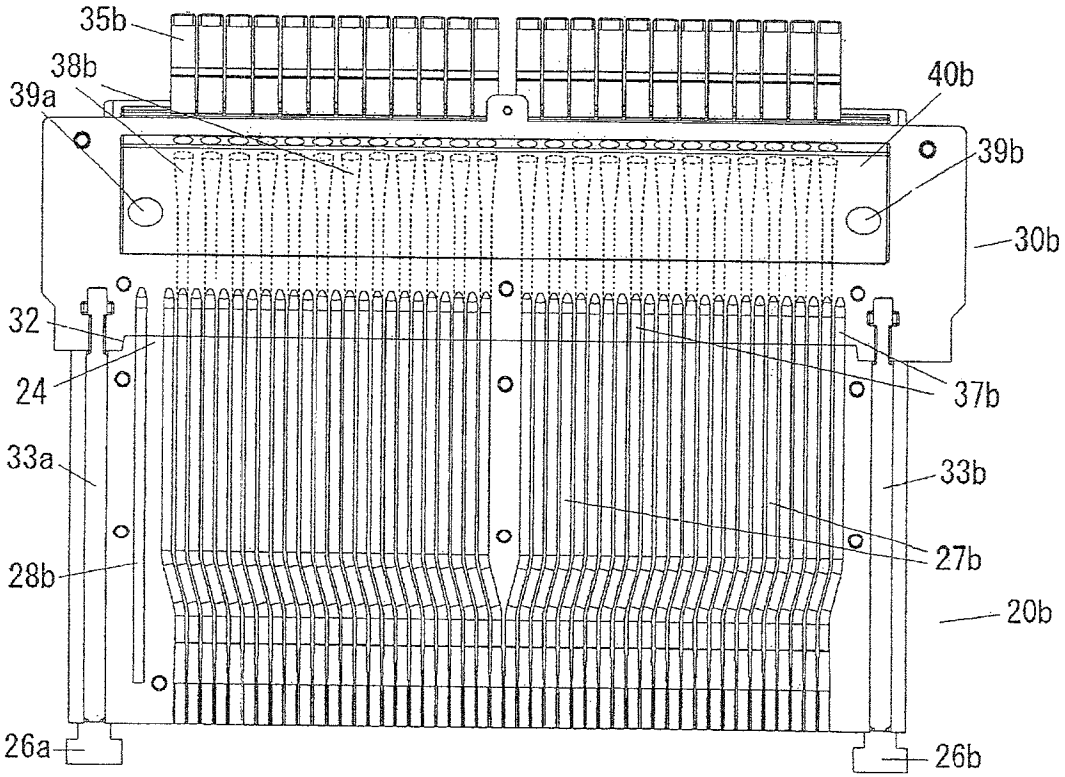
FIG. 7 is a plan view of a lower member constituting the ejector system.
Figure 8:
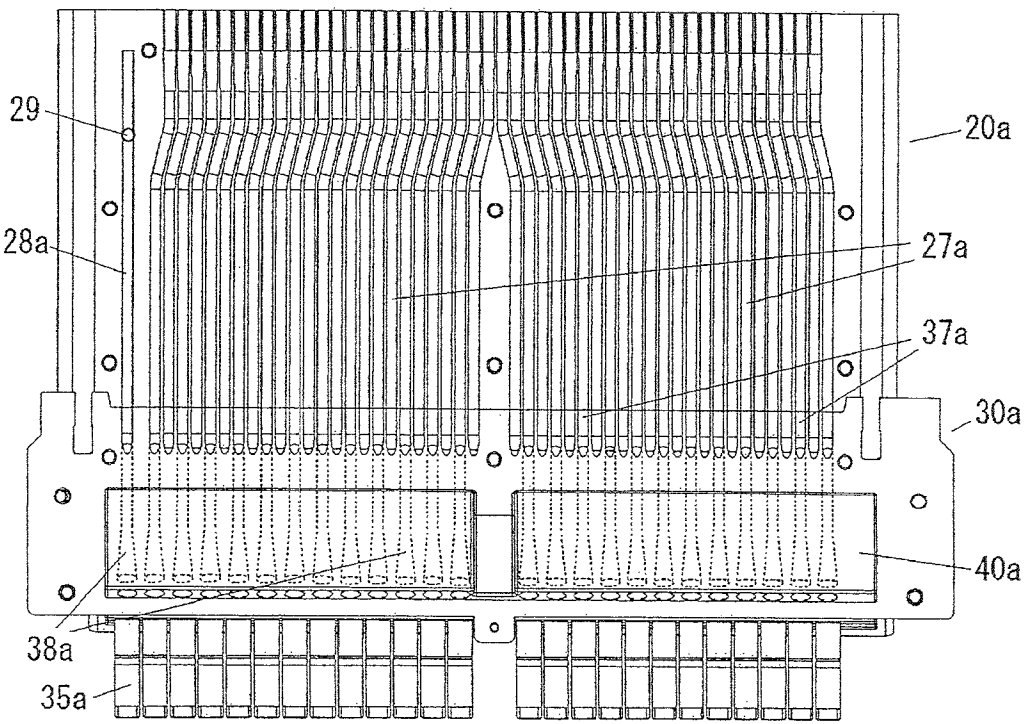
FIG. 8 is a bottom view of an upper member constituting the ejector system.

Next, FIG. 7 shows a plan view, in the detached state, of the nozzle upper member and the manifold upper member of the ejector system shown in FIG. 3. FIG. 8 shows a bottom view of the nozzle upper member and the manifold upper member in the detached state in FIG. 7.

As shown in FIG. 7, a plurality of slots 37*b*, 27*b* continuing in the width direction from the front of the manifold lower member 30*b* to the front end of the nozzle lower member 20*b* are formed on the upper surfaces of the nozzle and manifold lower members 20*b*, 30*b*.

At the back of the upper face of the manifold lower member 30*b*, there is formed an air space recess part 40*b* that opens onto the lower surface through air supply holes 39*a*, 39*b*. A plurality of communicating holes 38*b* are formed across the width direction of the manifold lower member 30*b*.

The air space recess part 40*b* communicates with the plurality of electromagnetic valves 35*b* that have been arranged on the back surface of the manifold lower member 30*b*. The communicating holes 38*b* communicate at the back end with the electromagnetic valves 35*b*, and communicate alternately at the front end with the slots 37*b* formed at the front of the manifold lower member 30*b*.

As shown in FIG. 8, a plurality of slots 37*a*, 27*a* continuing in the width direction from the front of the manifold upper member 30*a* to the front end of the nozzle upper member 20*a* are formed on the lower surfaces of the nozzle and manifold upper members 20*a*, 30*a*.

At the back of the lower face of the manifold upper member 30*a*, there is formed an air space recess part 40*a*. A plurality of communicating holes 38*a* are formed across the width direction of the manifold upper member 30*a*.

The air space recess part 40*a* communicates with the plurality of electromagnetic valves 35*a* that have been arranged on the back surface of the manifold upper member 30*a*. The communicating holes 38*a* communicate at the back end with the electromagnetic valves 35*a*, and communicate alternately at the front end with the slots 37*a* formed at the front of the manifold upper member 30*a*.

In the ejector system of the present embodiment, a plurality of independent air passages 27, 37 affording communication between the nozzle holes 21 and the communicating holes 38*a*, 38*b* are constituted by the slots 27*b*, 37*b* formed on the upper surfaces of the nozzle and manifold lower members 20*b*, 30*b* shown in FIG. 7, and the slots 27*a*, 37*a* formed on the lower surfaces of the nozzle and manifold upper members 20*a*, 30*a* shown in FIG. 8.

At this time, the slots 37*b* that communicate with the communicating holes 38*b* formed in the manifold lower member 30*b* constitute air passages to the slots 37*a* that do not communicate with the communicating holes 38*a* formed in the manifold upper member 30*a*. The slots 37*b* that do not communicate with the communicating holes 38*b* formed in the manifold lower member 30*b* constitute air passages to the slots 37*a* that communicate with the communicating holes 38*a* formed in the manifold upper member 30*a*.

A communicating hole 29 communicating with the upper surface of the nozzle upper member 20*a* is formed in the slot 28*a* that has been formed at the left end of the lower surface of the nozzle upper member 20*a* shown in FIG. 8. The slot 28*a* in question constitutes an air passage 28 communicating with the slot 28*b* that has been formed at the left end of the upper surface of the nozzle lower member 20*b* shown in FIG. 7, as well as with the nozzles 22 of the air sweeper 23 arranged on the upper surface of the nozzle part 20

In the ejector system of the present embodiment, an air space 40, discussed below, is constituted by the air space recess part 40*b* formed in the upper surface of the manifold lower member 30*b* shown in FIG. 7, and the air space recess part 40*a* formed in the lower surface of the manifold upper member 30*a* shown in FIG. 8. The air space 40 is a space for storing compressed air supplied from a compressed air source, not shown, to the air supply holes 39*a*, 39*b* that open onto the lower surface of the manifold lower member 30*b*.

Figure 9:
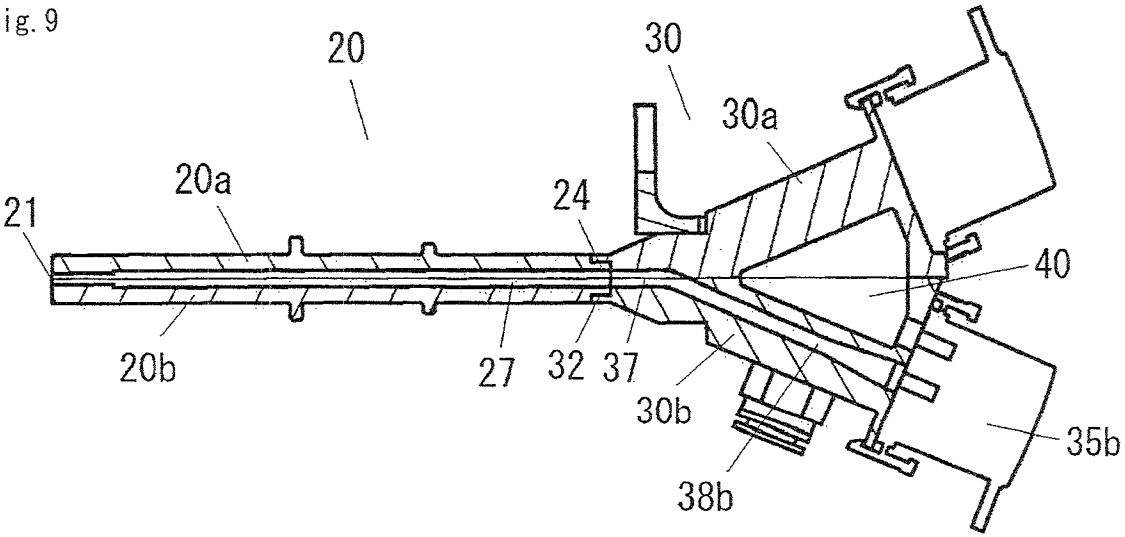
FIG. 9 is a sectional view taken along A-A in FIG. 3.
Figure 10:
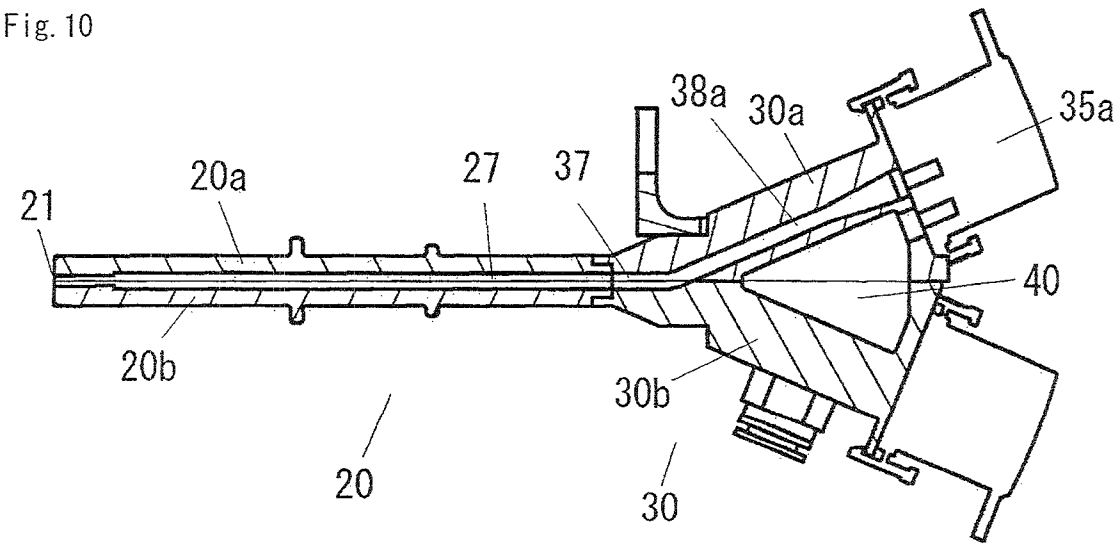
FIG. 10 is a sectional view taken along B-B in FIG. 3.

FIG. 9 shows an air flow path inside the nozzle part and the manifold part, taken along section A-A in FIG. 3. FIG. 10 shows an air flow path inside the nozzle part and the manifold part, taken along section B-B in FIG. 3.

The air flow path shown in FIG. 9, via the electromagnetic valve 35*b* arranged in the manifold lower member 30*b*, affords communication between the air space 40 formed in the manifold part 30 and the communicating hole 38*b* formed in the lower member 30*b*; and via the air flow path 37 formed at the front of the manifold part 30 and the air flow path 27 formed in the nozzle part 20, affords communication with the nozzle hole 21 that opens onto the front surface of the nozzle part 20.

The air flow path shown in FIG. 10, via the electromagnetic valve 35*a* arranged in the manifold upper member 30*a*, affords communication between the air space 40 formed in the manifold part 30 and the communicating hole 38*a* formed in the upper member 30*a*; and via the air flow path 37 formed at the front of the manifold part 30 and the air flow path 27 formed in the nozzle part 20, affords communication with the nozzle hole 21 that opens onto the front surface of the nozzle part 20.

The air flow paths shown in FIGS. 9 and 10 supply air from the air space 40 to the nozzle holes 21 through opening of the electromagnetic valves 35*a*, 35*b*.

For example, in the color sorter 1 shown in FIGS. 1 and 2, in a case in which an unsatisfactory item is detected by the optical detection devices 7*a*, 7*b*, and a position in the width direction of the falling trajectory of the particulate matter detected to be an unsatisfactory item corresponds to the position of the nozzle holes 21 shown in FIG. 9 or 10, the ejector system 8 of the present embodiment will open the electromagnetic valve 35*a*, 35*b* shown in FIG. 9 or 10, and thereby jet high pressure air stored in the air space 40, from either of the aforedescribed nozzle holes 21 over the predetermined air flow path.

Figure 11:
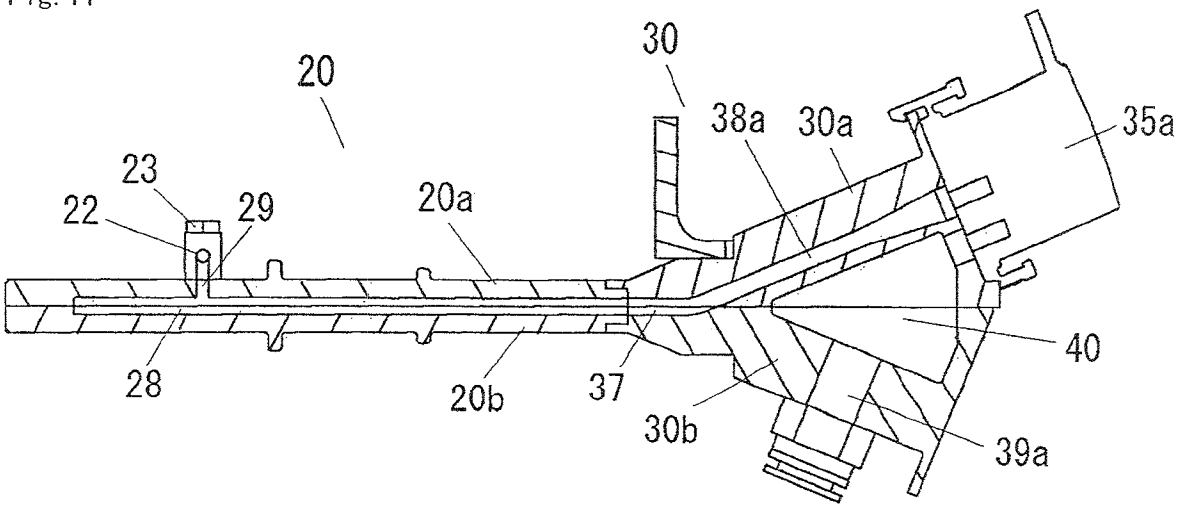
FIG. 11 is a sectional view taken along C-C in FIG. 3.

FIG. 11 shows an air flow path inside the nozzle part and the manifold part, taken along C-C in FIG. 3.

The air flow path shown in FIG. 11, via the electromagnetic valve 35*a* arranged in the manifold upper member 30*a*, affords communication between the air space 40 formed in the manifold part 30 and the communicating hole 38*a* formed in the upper member 30*a*; and via the communicating hole 29, affords communication between the air flow path 37 formed at the front of the manifold part 30 and the air flow path 28 formed in the nozzle part 20, and the nozzle 22 of the air sweeper 23 arranged on the upper surface of the nozzle part 20.

The air flow path shown in FIG. 11 likewise supplies the nozzle 22 of the air sweeper 23 with air from the air space 40, through opening of the electromagnetic valve 35*a*.

For example, by utilizing a timer in the color sorter 1 shown in FIGS. 1 and 2 to periodically open the electromagnetic valve 35*a* and jet air from the nozzle 22 depending on the running time of the color sorter 1, or by utilizing a sensor to open the electromagnetic valve 35*a* and jet air from the nozzle 22 depending on the condition of accumulation of dust or the like on the upper surface of the nozzle part 20, the upper surface of the nozzle part 20 can be cleaned automatically. Moreover, by switching the opening/closing action of the electromagnetic valve 35*a* to manual, the upper surface of the nozzle part 20 can be cleaned automatically through manual operation by a worker.

In the above manner, in the ejector system 8 of the present embodiment, the nozzle part 20 and the manifold part 30 are constituted such that it is possible for them to be easily assembled and separated, improving the cleaning and maintenance performance.

Moreover, in the ejector system 8 of the present embodiment, the nozzle part 20 and the manifold part 30 are constituted by screwing together upper and lower members, and therefore the upper and lower members can be easily separated, so that the air passages 27, 37 formed on the opposed surfaces of the upper and lower members can be easily cleaned.

In the ejector system 8 of the present embodiment, at one side end of the upper surface of the nozzle part 20, there has been arranged the air sweeper 23 provided with nozzles 22 that open towards the other side end of the upper surface of the nozzle part 20, whereby starting material, dust, and the like accumulating on the upper surface of the nozzle part 20 can be cleaned automatically, and the burden of cleaning or maintenance performed by workers can be reduced.

The ejector system 8 of the present embodiment is constituted such that when the plurality of electromagnetic valves 35*a*, 35*b* are respectively arranged on the upper and lower members 30*a*, 30*b* constituting the manifold part 30, the phase of the electromagnetic valves 35*a* arranged on the upper member 30*a* and that of the electromagnetic valves 35*b* arranged on the lower member 30*b* are made different from one another, and therefore the number of nozzle holes that open onto the front surface of the nozzle part can be increased to double, as compared with a case in which the electromagnetic valves are arranged on one member only.

In the ejector system of the aforedescribed embodiment, the nozzle part 20 and the manifold part 30 are integrated by inserting the pair of rods 33*a*, 33*b* attached to the manifold part 30 into the pair of through-holes 25*a*, 25*b* formed in the nozzle part 20, and threading and tightening the female thread parts of the fastening members 26*a*, 26*b* onto the distal end male thread parts of the rods 33*a*, 33*b* that project out through the through-holes 25*a*, 25*b*; however, the nozzle part 20 and the manifold part 30 may be integrated by other means.

In the ejector system of the aforedescribed embodiment, the air flow paths 27, 37 that are formed on the opposed surfaces of the upper and lower members of the nozzle part 20 and the manifold part 30 are constituted by slots formed in the upper surface of the lower members and slots formed in the lower surface of the upper members; however, provided that the air flow paths 27, 37 are formed in the opposed surfaces of the upper and lower members of the nozzle part 20 and the manifold part 30, it is acceptable for the slots constituting the air flow paths 27, 37 to be formed in either the upper or lower member only.

In the ejector system of the aforedescribed embodiment, the nozzle part 20 and the manifold part 30 are respectively constituted by screwing together an upper and a lower member; however, these could be respectively constituted as single members. In this case, the air flow paths formed in the parts may be formed as through-holes.

In the ejector system of the aforedescribed embodiment, the air sweeper 23 is arranged on the upper surface of the nozzle part 20; however, the arrangement of the air sweeper 23 is arbitrary.

In the ejector system of the aforedescribed embodiment, the electromagnetic valves 35 are arranged in two rows on the manifold part 30; however, the electromagnetic valves 35 may instead be arranged in three or more rows, or arranged in a single row only, as in the prior art.

Example of Implementation of Ejector System in a Color Sorter

Figure 12:
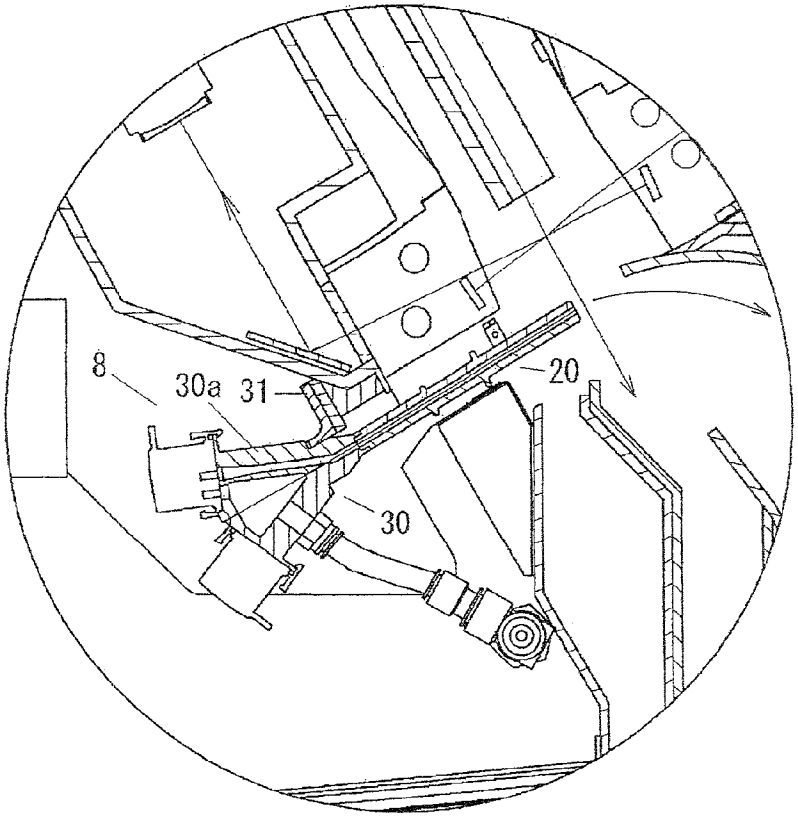
FIG. 12 is a partially enlarged view of FIG. 2.
Figure 13:
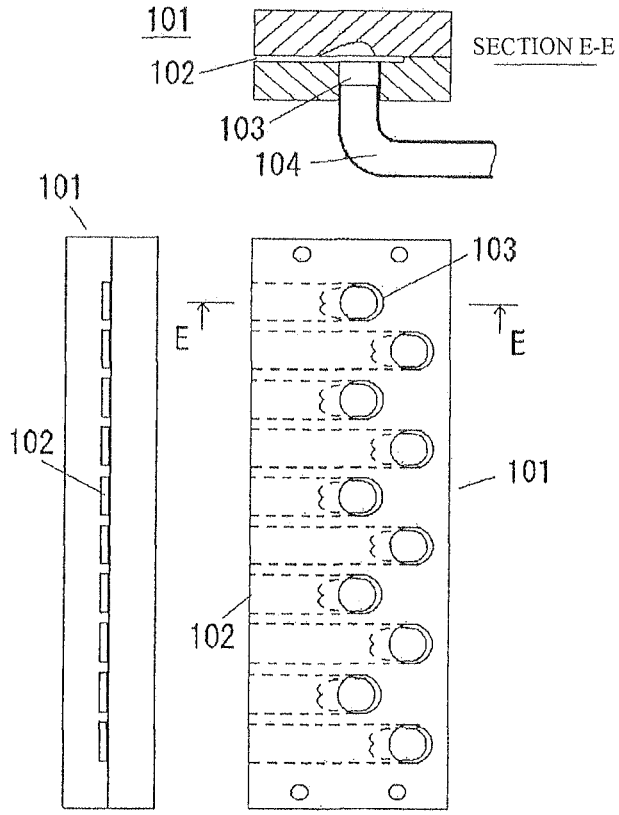
Fig. 13 PRIOR ART
FIG. 13 is an ejector nozzle of the prior art.
Figure 14:
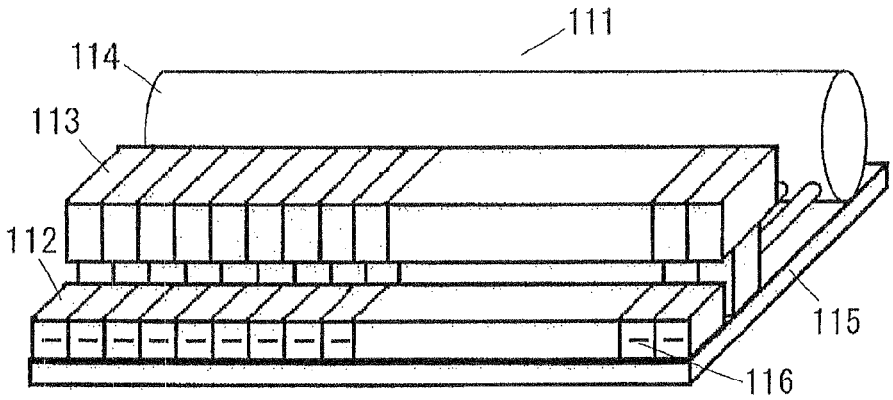
Fig. 14 PRIOR ART
FIG. 14 is an air jetting device of the prior art.

FIG. 12 is an example of implementation of the ejector system of the present invention in a color sorter, and shows a partial enlarged view of FIG. 2.

As shown in FIG. 12, the ejector system 8 of the present embodiment is fastened to the body of the color sorter by the attachment member 31, which has been screwed to the upper surface at the front of the manifold upper member 30*a*.

In the process, the ejector system 8 is arranged such that the nozzle part 20 is positioned on the flow path of the particulate matter, and the manifold part 30 is positioned in the interior of the sorter body.

In the ejector system 8 of the present embodiment, because the manifold part 30 is positioned in the interior of the sorter body, soiling of the electromagnetic valves by dust and the like stirred up within the flow path in association with falling of the particulate matter can be prevented.

The ejector system 8 of the present embodiment is not limited to application in the aforedescribed color sorter 1; implementation in all manner of color sorters is possible.

The present invention is not limited to the aforedescribed embodiments; various modifications of the constitution thereof can be made, as appropriate, without departing from the scope of the claims.

INDUSTRIAL APPLICABILITY

The ejector system employed in the color sorter of the present invention has excellent cleaning and maintenance performance by virtue of a constitution whereby the nozzle part and the manifold part are integrated by a separable structure, and the application value is accordingly high.

REFERENCE SIGNS LIST

1 Color sorter
2 Loading hopper
3 Bucket conveyor
4 Storage tank
5 Rotary valve
6 Sloping chute
7*a*, 7*b* Optical detection devices
8 Ejector system
9 Particulate matter discharge trough
9*a* Satisfactory item discharge trough
9*b* Unsatisfactory item discharge trough
10*a*, 10*b* Sensors
11*a*, 11*b* Mirrors
12*a*, 12*b* Illumination means
13*a*, 13*b* Background means
20 Nozzle part
20*a* Nozzle upper member
20*b* Nozzle lower member
21 Nozzle holes
22 Nozzles
23 Air sweeper
24 Projection part
25*a*, 25*b* Through holes
26*a*, 26*b* Fastening members
27 Air flow paths
27*a*, 27*b* Slots
28 Air flow paths
28*a*, 28*b* Slots
30 Manifold part
30*a* Manifold upper member
30*b* Manifold lower member
31 Attachment member
32 Recess part
33*a*, 33*b* Rods
34*a*, 34*b* Rod attachment holes
35*a*, 35*b* Electromagnetic valves
36*a*, 36*b* Air line connection parts
37 Air flow paths
37*a*, 37*b* Slots
38*a*, 38*b* Communicating holes
39*a*, 39*b* Air supply holes
40 Air space
40*a*, 40*b* Air space recess parts

The invention claimed is:

1. An ejector system for a color sorter in which particulate matter falling from the end of a transfer device is detected at a predetermined position, and based on the result of the detection, the particulate matter is eliminated by air, the ejector system comprising: a nozzle part in which a plurality of nozzle holes open at the front end, and in which are formed a plurality of air flow paths that communicate with the nozzle holes; and a manifold part in which is formed an air space communicating with a compressed air source, the manifold part being provided with a plurality of electromagnetic valves communicating with the air space, and in which are formed a plurality of air flow paths for supplying compressed air to corresponding air flow paths of said nozzle part by operation of the electromagnetic valves, said nozzle part and said manifold part being separably integrated in a state in which the open surfaces of the air flow paths in said nozzle part and the open surfaces of the air flow paths in said manifold part are brought in contact with each other.

2. The ejector system for a color sorter according to claim 1, wherein the open surfaces of the air flow paths in said nozzle part and the open surfaces of the air flow paths in said manifold part are fitted together as projections and recesses, and said nozzle part and said manifold part are separably integrated by a pair of rods extending from the manifold part being inserted into a pair of through-holes formed in the nozzle part.

3. The ejector system for a color sorter according to claim 1, wherein said nozzle part is constituted by screwing together a nozzle upper member and a nozzle lower member, said manifold part is constituted by screwing together a manifold upper member and a manifold lower member, and said air flow paths are formed on opposed surfaces of said respective upper and lower members.

4. The ejector system for a color sorter according to claim 1, arranged with respect to the color sorter such that said nozzle part is positioned on the flow path of the particulate matter, and said manifold part is positioned in the interior of the sorter body.

5. The ejector system for a color sorter according to claim 1, wherein at one side end of the upper surface of said nozzle part, there is arranged an air sweeper provided with nozzles opening towards the other side end of the upper surface of the nozzle part; in said nozzle part, there are formed air flow paths that communicate with the nozzles of the air sweeper; and in said manifold part, there are arranged electromagnetic valves that communicate with said air space, and there are formed air flow paths that, by operation of the electromagnetic valves, supply compressed air to air flow paths communicating with the nozzles of said air sweeper formed in said nozzle part.

6. The ejector system for a color sorter according to claim 2, wherein said nozzle part is constituted by screwing together a nozzle upper member and a nozzle lower member, said manifold part is constituted by screwing together a manifold upper member and a manifold lower member, and said air flow paths are formed on opposed surfaces of said respective upper and lower members.

7. The ejector system for a color sorter according to claim 2, arranged with respect to the color sorter such that said nozzle part is positioned on the flow path of the particulate matter, and said manifold part is positioned in the interior of the sorter body.

8. The ejector system for a color sorter according to claim 3, arranged with respect to the color sorter such that said nozzle part is positioned on the flow path of the particulate matter, and said manifold part is positioned in the interior of the sorter body.

9. The ejector system for a color sorter according to claim 2, wherein at one side end of the upper surface of said nozzle part, there is arranged an air sweeper provided with nozzles opening towards the other side end of the upper surface of the nozzle part; in said nozzle part, there are formed air flow paths that communicate with the nozzles of the air sweeper; and in said manifold part, there are arranged electromagnetic valves that communicate with said air space, and there are formed air flow paths that, by operation of the electromagnetic valves, supply compressed air to air flow paths communicating with the nozzles of said air sweeper formed in said nozzle part.

10. The ejector system for a color sorter according to claim 3, wherein at one side end of the upper surface of said nozzle part, there is arranged an air sweeper provided with nozzles opening towards the other side end of the upper surface of the nozzle part; in said nozzle part, there are formed air flow paths that communicate with the nozzles of the air sweeper; and in said manifold part, there are arranged electromagnetic valves that communicate with said air space, and there are formed air flow paths that, by operation of the electromagnetic valves, supply compressed air to air flow paths communicating with the nozzles of said air sweeper formed in said nozzle part.

11. The ejector system for a color sorter according to claim 4, wherein at one side end of the upper surface of said nozzle part, there is arranged an air sweeper provided with nozzles opening towards the other side end of the upper surface of the nozzle part; in said nozzle part, there are formed air flow paths that communicate with the nozzles of the air sweeper; and in said manifold part, there are arranged electromagnetic valves that communicate with said air space, and there are formed air flow paths that, by operation of the electromagnetic valves, supply compressed air to air flow paths communicating with the nozzles of said air sweeper formed in said nozzle part.

* * * * *